US007565822B2

(12) United States Patent
Park et al.

(10) Patent No.: US 7,565,822 B2
(45) Date of Patent: Jul. 28, 2009

(54) WASHING MACHINE USING STEAM AND METHOD FOR CONTROLLING THE SAME

(75) Inventors: Seog Kyu Park, Changwon-si (KR); In Geun Ahn, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/978,681

(22) Filed: Oct. 30, 2007

(65) Prior Publication Data

US 2008/0120787 A1 May 29, 2008

Related U.S. Application Data

(62) Division of application No. 11/628,192, filed on Oct. 3, 2007.

(51) Int. Cl.
*D06F 33/02* (2006.01)

(52) U.S. Cl. ..... 68/15; 68/207

(58) Field of Classification Search ..... 68/15, 68/207; 134/184, 198
See application file for complete search history.

(56) References Cited

U.S. PATENT DOCUMENTS

| | | | | |
|---|---|---|---|---|
| 1,487,907 | A | 3/1924 | Yates | |
| 1,501,746 | A | 7/1924 | Carter | |
| 1,536,230 | A | 5/1925 | McCue | |
| 1,570,552 | A | 1/1926 | Bowerbank | |
| 1,646,299 | A | 10/1927 | Leo | |
| 1,755,101 | A | 4/1930 | Fording et al. | |
| 1,755,746 | A | 4/1930 | Clark et al. | |
| 1,852,179 | A * | 4/1932 | McDonald | 68/183 |
| 1,947,752 | A | 2/1934 | Benesh | |
| 2,277,291 | A | 3/1942 | Blair | |
| 2,355,882 | A | 8/1944 | Malsbary et al. | |
| 2,404,450 | A | 7/1946 | Meyer | |
| 2,431,246 | A | 11/1947 | Hallanan | |

(Continued)

FOREIGN PATENT DOCUMENTS

CN 2154278 Y 1/1994

(Continued)

OTHER PUBLICATIONS

European Patent Office 1 441 059 Nov. 2003.*

(Continued)

*Primary Examiner*—Frankie L Stinson
(74) *Attorney, Agent, or Firm*—McKenna Long & Aldridge LLP

(57) ABSTRACT

A washing machine using steam and a method for controlling the same is disclosed. The washing machine with a steam generator (100) selectively supplying steam into a drum (30) according to the present invention includes a course select part (420) for a user to select a wash course, a steam select part (430) for a user to select whether steam washing is operated and a controller (440) for controlling the steam generator (100) based on a wash course selected from the course select part (420) (an inputted wash course) and a signal selected from the steam select part (430). The present invention has an advantageous effect that convenience is improved for a user to use the washing machine using steam as well as washing performance is improved, because disadvantages due to malfunctions of a steam generator are prevented.

80 Claims, 5 Drawing Sheets

U.S. PATENT DOCUMENTS 2,516,282 A 7/1950 Wuktib
2,547,098 A 11/1951 Pasco
2,574,098 A 11/1951 Fraraccio
2,574,900 A 11/1951 Williams et al.
2,585,608 A 2/1952 Wieghart
2,648,305 A * 8/1953 Appleman ..... 116/310
2,664,094 A 12/1953 Spragins
2,861,838 A 11/1958 Wyatt et al.
2,880,300 A 3/1959 Reimers et al.
2,925,223 A 2/1960 Reddick et al.
3,025,381 A 3/1962 Pickering
3,102,796 A * 9/1963 Erickson ..... 34/75
3,203,013 A 8/1965 Alvin
3,347,066 A 10/1967 Klausner
3,402,576 A * 9/1968 Krupsky ..... 68/4
3,410,986 A 11/1968 Groom
3,443,406 A 5/1969 Hornback et al.
3,473,175 A 10/1969 Sieber
3,583,181 A 6/1971 Brillet
3,611,456 A * 10/1971 Hildebrandt ..... 8/149.1
3,615,822 A 10/1971 Molinari
3,660,013 A * 5/1972 Payet et al. ..... 8/116.4
3,672,188 A 6/1972 Geschka et al.
3,705,602 A 12/1972 Nordin et al.
3,730,682 A 5/1973 Brubaker et al.
3,732,628 A * 5/1973 Blevens et al. ..... 34/389
3,776,471 A 12/1973 Meyer et al.
3,890,987 A 6/1975 Marcussen et al.
3,935,719 A 2/1976 Henderson
4,187,138 A 2/1980 Thwaites et al.
4,204,339 A 5/1980 Muller
4,287,407 A 9/1981 Treiber et al.
4,311,160 A 1/1982 Charland
4,354,364 A * 10/1982 Holder et al. ..... 68/18 R
4,414,037 A * 11/1983 Friedheim ..... 134/35
4,471,792 A 9/1984 Koblenzer
4,527,343 A * 7/1985 Danneberg ..... 34/452
4,582,025 A 4/1986 Grasso
4,643,775 A 2/1987 Reba et al.
4,941,333 A 7/1990 Blessing
5,130,078 A 7/1992 Dillman
5,161,394 A 11/1992 Felzer et al.
5,180,438 A 1/1993 Hockh et al.
5,180,483 A 1/1993 Braams et al.
5,219,371 A 6/1993 Shim et al.
5,255,840 A 10/1993 Nowotarski
5,313,811 A 5/1994 Wasinger et al.
5,361,322 A 11/1994 Gluksman et al.
5,368,008 A 11/1994 Oslin
5,390,385 A * 2/1995 Beldham ..... 8/158
5,392,738 A 2/1995 Tsutsumi et al.
5,425,255 A 6/1995 Pick
5,439,655 A 8/1995 Fedegari
5,491,857 A 2/1996 Love et al.
5,561,880 A * 10/1996 Allen et al. ..... 8/149.3
5,723,847 A 3/1998 Boldt
5,827,329 A 10/1998 Champeau
5,953,939 A 9/1999 Guerrero-Parra et al.
5,962,288 A 10/1999 Aksenov et al.
5,989,203 A 11/1999 Wang et al.
6,006,398 A 12/1999 Larson et al.
6,161,306 A 12/2000 Clodic et al.
6,213,614 B1 * 4/2001 Gjerde ..... 362/23
6,299,076 B1 10/2001 Sloan et al.
6,311,527 B1 11/2001 Monteiro et al.
6,397,874 B1 6/2002 Featheringill et al.
6,477,868 B2 11/2002 Chang et al.
6,585,781 B1 * 7/2003 Roseen ..... 8/149.1
6,622,529 B1 9/2003 Crane
6,691,536 B2 2/2004 Severne et al.
6,811,811 B2 11/2004 Gerald France et al.
6,854,300 B2 2/2005 Monteiro et al.
6,889,399 B2 * 5/2005 Steiner et al. ..... 8/159
6,898,951 B2 5/2005 Severns et al.
7,021,087 B2 4/2006 France et al.
7,275,400 B2 10/2007 Severns et al.
2003/0061841 A1 4/2003 Nakamura et al.
2003/0184597 A1 10/2003 Jo et al.
2004/0187527 A1 9/2004 Kim et al.
2004/0187529 A1 9/2004 Kim et al.
2004/0261824 A1 12/2004 Eiermann
2005/0034248 A1 2/2005 Oh et al.
2005/0144734 A1 7/2005 Yang et al.

FOREIGN PATENT DOCUMENTS

CN 1444676 9/2003
CN 1702225 A 11/2005
DE 483793 10/1929
DE 604415 10/1934
DE 19546967 6/1997
DE 197 43 508 A1 8/1999
EP 0299343 1/1989
EP 0365500 4/1990
EP 0816550 7/1998
EP 1 087 051 3/2001
EP 1275767 1/2003
EP 1489217 A1 12/2004
EP 1 507 031 A1 2/2005
EP 1 507 038 A1 2/2005
EP 1507032 A1 2/2005
EP 1 600 545 11/2005
GB 21286 6/1898
GB 10423 11/1909
GB 21024 2/1910
GB 799788 8/1958
GB 1222227 2/1971
GB 2348213 9/2000
GB 2 366 809 3/2002
GB 2366809 3/2002
JP 59-108592 * 6/1984
JP 61-128995 6/1986
JP 63-166182 10/1988
JP 02-198595 8/1990
JP 239894 9/1990
JP 04-158896 1/1992
JP 5-23493 2/1993
JP 10-235088 9/1998
JP 11-115033 4/1999
JP 1999-226290 8/1999
JP 2000-176192 6/2000
JP 2000-325692 11/2000
JP 2002-181306 A 6/2002
JP 2003-019382 1/2003
JP 2003-3775 4/2003
JP 2003093775 4/2003
JP 2003311084 11/2003
KR 93-19820 9/1993
KR 10-1996-14251 10/1996
KR 10-1997-0070295 A 11/1997
KR 10-1998-26340 7/1998
KR 10-0172877 B1 5/1999
KR 10-2002-57119 7/2002
KR 10-2003-20940 3/2003
KR 2003-043011 6/2003
KR 10-2004-0088884 A 10/2004
KR 10-2005-0015758 A 2/2005
KR 10-2005-0017489 A 2/2005
KR 10-2005-0017490 A 2/2005
KR 10-2005-0042127 A 5/2005
KR 10-2005-0045968 A 5/2005

| | | | |
|---|---|---|---|
| SU | 1669724 | | 8/1991 |
| WO | WO-97/15709 | A1 | 5/1997 |
| WO | WO 97/20493 | | 6/1997 |
| WO | WO 03-012185 | | 2/2003 |
| WO | WO 03055373 | | 7/2003 |

OTHER PUBLICATIONS

European Patent Office 1 275 767 Apr. 2002.*
European Patent Office 1 275 767 Apr. 2001.*

* cited by examiner

[Fig. 1]
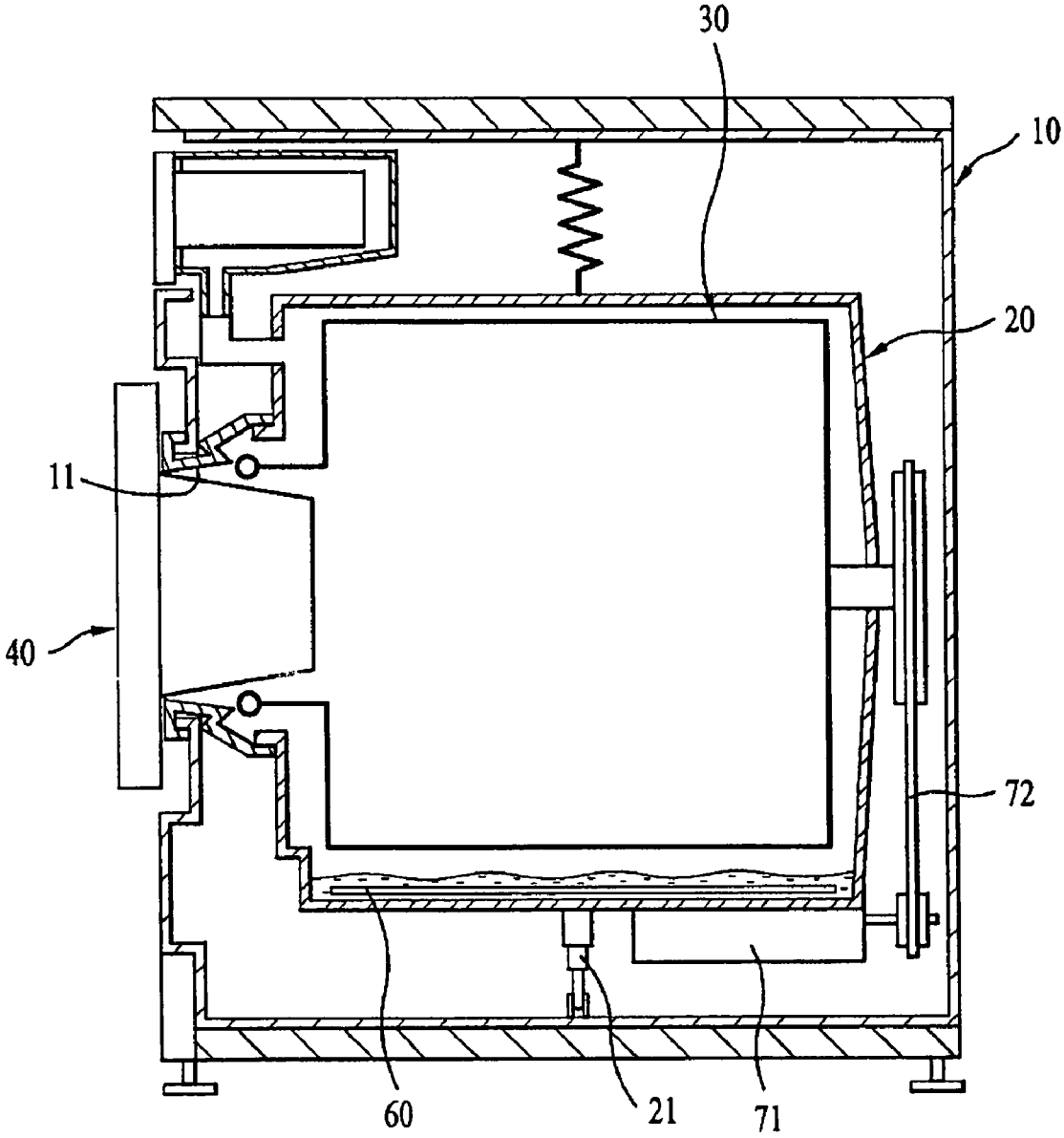

[Fig. 2]
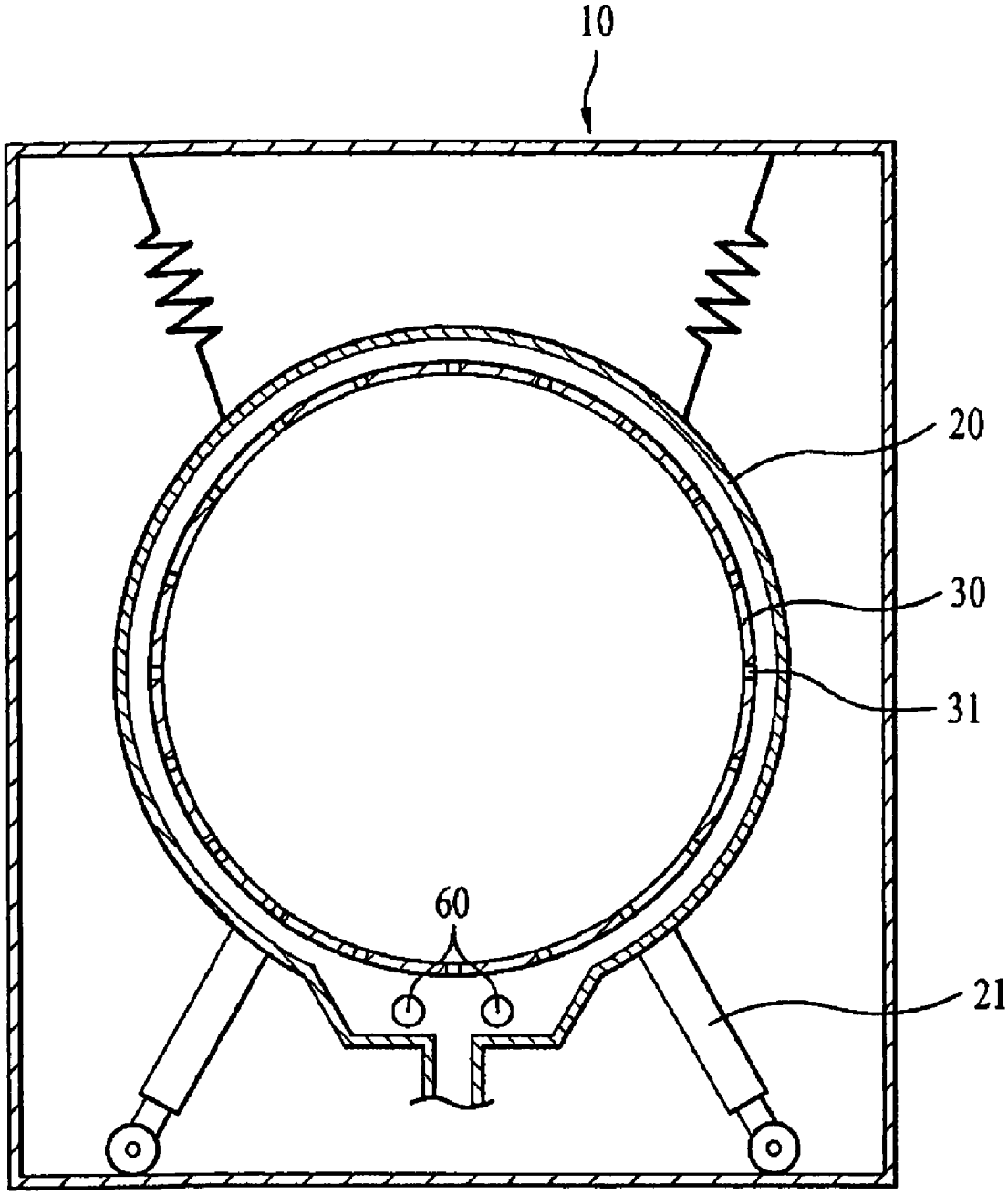

[Fig. 3]
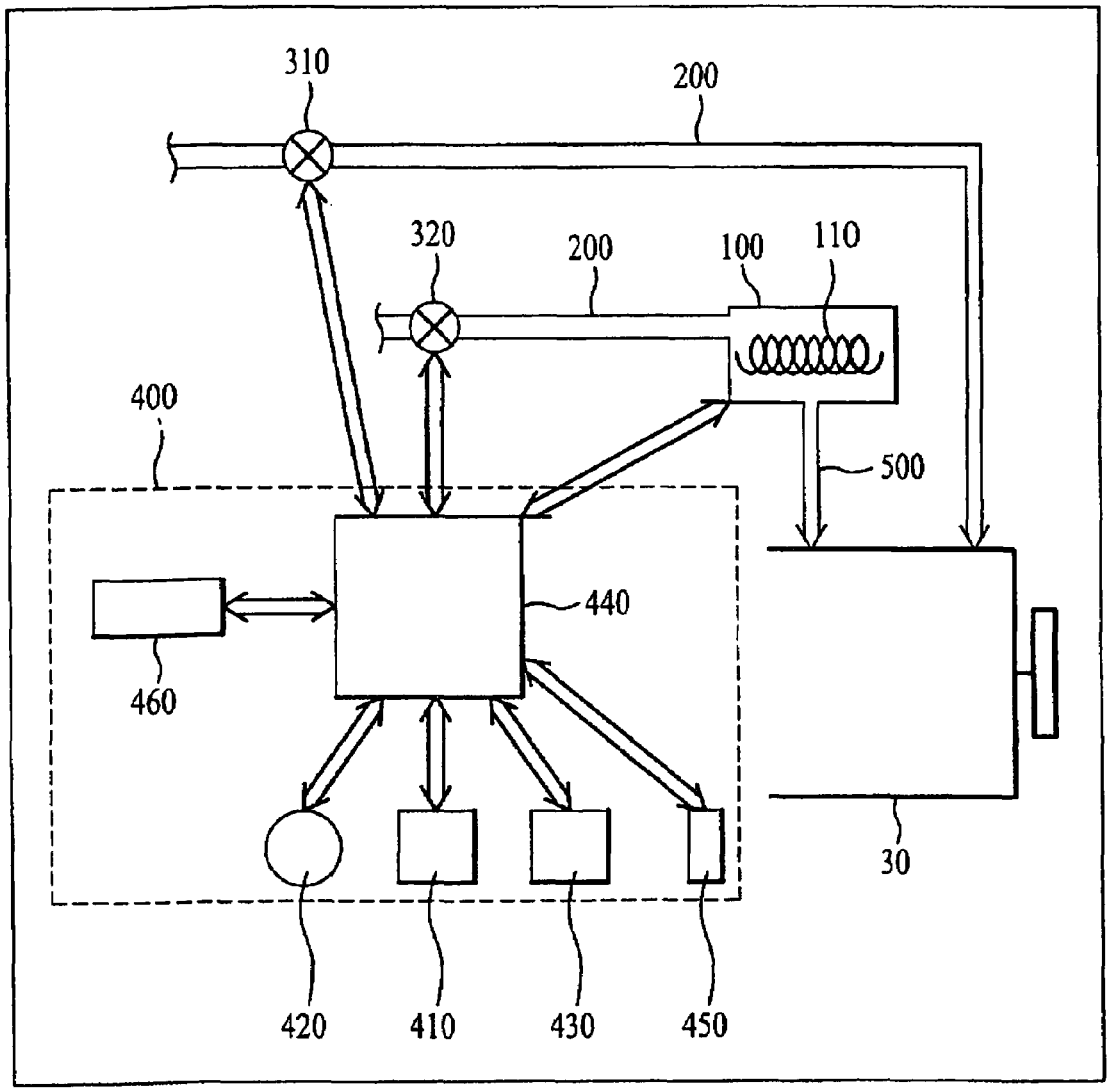

[Fig. 4]
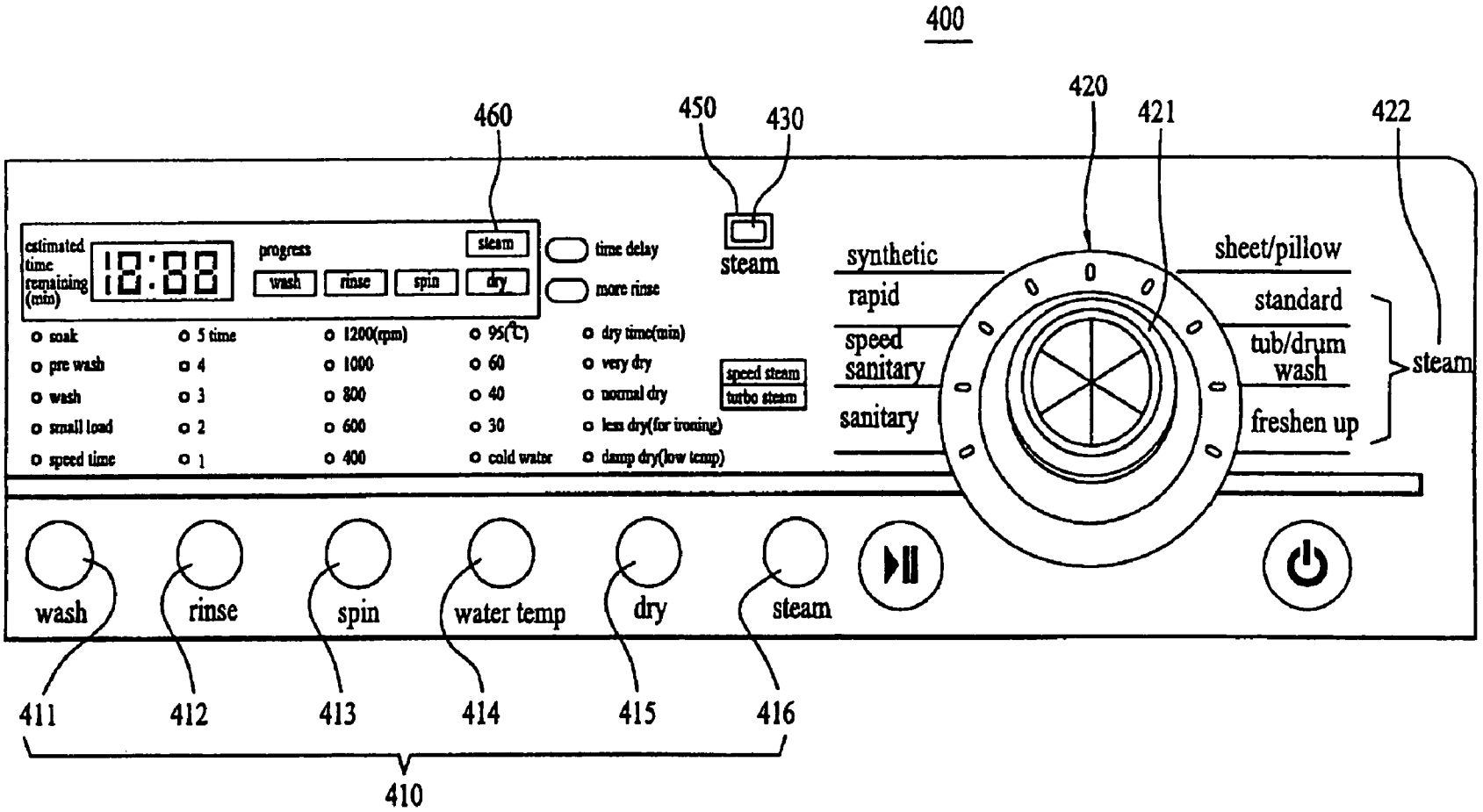

[Fig. 5]
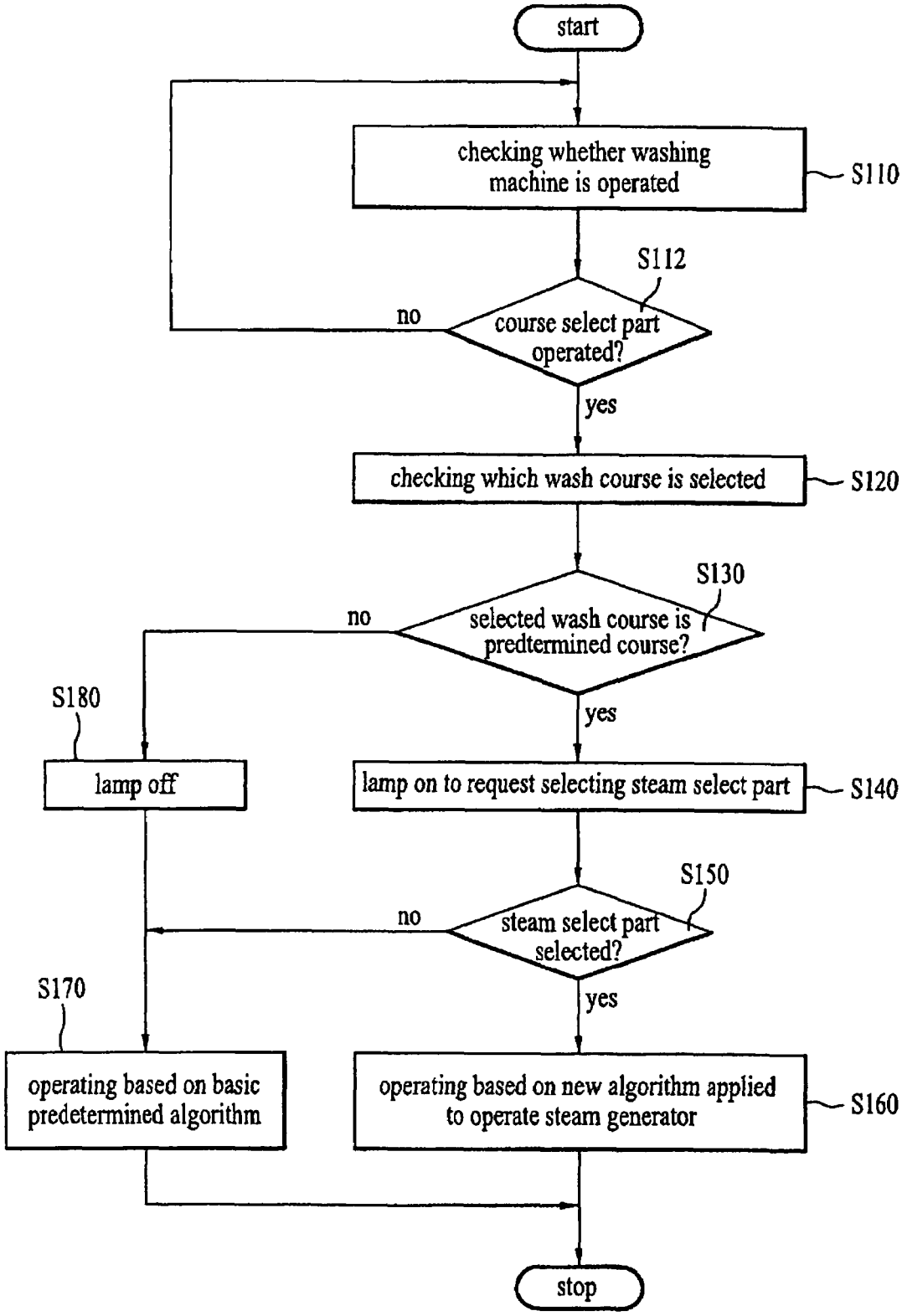

WASHING MACHINE USING STEAM AND METHOD FOR CONTROLLING THE SAME

This application is a divisional of application Ser. No. 11/628,192, filed Oct. 3, 2007, which claims the benefit of PCT/KR2006/000890, filed on Mar. 13, 2006, and claims priority to Korean Patent Application Nos. 10-2005-0021796, 10-2005-0021797 each filed on Mar. 16, 2005, and 10-2005-0035031, 10-2005-0035044 each filed on Apr. 27, 2005, all of which hereby incorporated herein by reference in their entireties.

TECHNICAL FIELD

The present invention relates to a washing machine and a method for controlling the same, and more particularly, to a washing machine using steam and a method for controlling the same.

BACKGROUND ART

In general, a washing machine is classified into a pulsator type, a drum type and an agitator type washing machine.

Referring to FIGS. 1 and 2, a drum type washing machine will be described as an embodiment of a conventional washing machine.

The drum type washing machine includes a body 10, an outer tub 20 mounted within the body 10, a drum 30 rotatably mounted within the outer tub 20, a driving unit for driving the drum 30. An opening 11 is formed in front of the body 10 for loading/unloading the laundry, and a door 40 is coupled to the opening 11 for opening/closing the opening 11.

A damper 21 is provided between the outer tub 20 and the body 10. A heater 60 is provided within the outer tub 20, such that it is possible to control a wash water temperature. The drum 30 is rotatably mounted within the outer tub 20 and a plurality of through holes 31 is formed on a circumferential surface of the drum for drawing/discharging wash water.

The driving unit includes a motor 71 to drive the drum 30, a belt 72 connected with the motor to transmit the driving force of motor 71 to the drum 30. Alternatively, the driving unit may employ a motor directly connected to the drum 30.

In the conventional drum type washing machine, commonly, the laundry and detergent is mixedly supplied within the drum 30. Hence, washing cycles including a wash, a rinse and a spin step according to a control signal of a controller (not shown) are automatically performed. Each of the wash, the rinse and the spin step could be operated individually.

Recently, a washing machine using steam has been under development for improving washing performance as well as economizing in wash water and energy. Commonly, the washing machine using steam has been supplied new components such as a steam generator.

DISCLOSURE OF INVENTION

Technical Problem

An object of the present invention is to provide a washing machine using steam which has improved convenience.

Another object of the present invention is to provide a washing machine using steam which has improved washing performance.

Technical Solution

To achieve these objects and other advantages and in accordance with the purpose of the invention, as embodied and broadly described herein, a washing machine with a steam generator selectively supplying steam into a drum includes: a course select part for a user to select a wash course; a steam select part for a user to select whether steam washing is operated; and a controller for controlling the steam generator based on a wash course selected at the course select part (an inputted wash course) and a signal selected from the steam select part.

The controller receives a signal from the steam select part in case that the inputted wash course is a predetermined wash course using steam (a steam wash course). Also, a signal from the steam select part is transmitted to the controller in case that the inputted wash course is the seam wash course.

Meanwhile, a steam wash select displayer is further provided for notifying that the steam select part is selectable in case that the inputted wash course is the steam wash course. Preferably, the steam wash select displayer includes a lamp.

The wash course inputted from the course select part may include at least one of a laundry kind course, a standard course, a sanitary course, a tub/drum wash course and freshen up course. Preferably, the steam wash course includes at least one of the standard course, the tub/drum wash course and the freshen up course.

Furthermore, a water supply valve is provided for controlling water supply into the steam generator, and is controlled by the controller once steam washing is selected through the steam select part. Also, a switch is provided for controlling power supply into a heater of the steam generator, and is controlled by the controller in case that steam washing is selected from the steam select part.

Meanwhile, a steam wash displayer is also provided for displaying that washing using steam is under operation in case that a steam wash course is selected at the course select part and steam washing is selected at the steam select part. The steam wash displayer is a lamp selectively turning on/off.

In a further aspect of the present invention, a steam adjust part is further provided for selecting various factors for steam generation. The steam adjust part is at least one of the steam select part and another steam adjust button.

Still further, at least one of an economical steam, a turbo steam and a small steam may be selected at the steam adjust part. Also, preferably the steam generator is operated until the temperature of drum reaches a preset temperature in case that a steam wash with a relatively large amount of steam is selected, and the steam generator is operated for a preset time period in case that a steam wash with a relatively small amount of steam is selected.

Meanwhile, the course select part includes a rotation knob and the course select part includes a touch panel.

In a further aspect of the present invention, an option select part is provided for selecting particular control of each wash course. The option select part comprises a adjust button for controlling particular options of the steam generation.

In a further aspect of the present invention, a steam wash select part is provided for notifying that the steam select part is selectable. The steam wash select part comprises a lamp selectively turning on/off.

In a further aspect of the present invention, an indicator is provided for alerting a user which wash course among the course select part is used as the steam wash course.

In another aspect of the present invention, provided herein is a washing machine with a steam generator selectively supplying steam into a drum including: a course select part having a selected wash course inputted therein; a controller for selectively operating the steam generator after judging whether the wash course inputted in the course select part can perform steam washing and whether a steam wash is selected in case that the inputted wash course can perform steam washing.

In a further aspect of the present invention, provided herein is a washing machine with a steam generator selectively supplying steam into a drum including: a course select part for a user to select a wash course; a controller to operate a corresponding wash course according to a wash course inputted from the course select part (an inputted wash course); and an indicator for alerting a user which wash course is a wash course using steam (a steam wash course). The indicator is at least one of a lamp selectively turning on/off and a print part where letters are printed.

In a further aspect of the present invention, provided herein is a method for controlling a washing machine with a steam generator selectively supplying steam into a drum comprising a step of controlling the steam generator based on a wash course selected by a user (an inputted wash course) and a steam wash command selected by a user (a steam select signal). Preferably, the steam wash signal is ignored by the controller once the inputted wash course is not a predetermined steam wash course. The steam wash signal is not transmitted to the controller once the inputted wash course is not a predetermined steam wash course.

Also, preferably, a step of alerting a user that the steam wash course may be selected once the inputted wash course is a predetermined steam course is included.

In a further aspect of the present invention, provided herein is a method for controlling a washing machine with a steam generator selectively supplying steam into a drum comprising steps of inputting a selected wash course; and alerting a user whether a steam wash course is selectable if the inputted wash course is a predetermined wash course capable of using steam (a steam wash course). Here, a step of receiving a steam wash command made by a user only in case that the inputted wash course is one of the steam wash courses is further included. Also, preferably, a step of notifying a user that a steam wash is not a selectable, when a steam wash command is inputted in case that the inputted wash course is not a steam wash course is further included.

ADVANTAGEOUS EFFECTS

A washing machine using steam and a method for controlling the same according to the present invention has an advantageous effect that convenience is improved for a user to use the washing machine using steam as well as washing performance is improved, because disadvantages due to malfunctions of a steam generator are prevented.

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIGS. 1 and 2 are sectional views illustrating a related art drum type washing machine.

FIG. 3 is a diagram schematically illustrating an embodiment of a washing machine according to the present invention.

FIG. 4 is a diagram illustrating an example of a control assembly of the washing machine according to the present invention.

FIG. 5 is a flow chart illustrating a method for controlling the embodiment of the washing machine according to the present invention.

BEST MODE FOR CARRYING OUT THE INVENTION

Reference will now be made in detail to the preferred embodiments of the present invention, examples of which are illustrated in the accompanying drawings.

Referring to FIG. 3, a preferred embodiment of a washing machine according to the present invention will be described. Especially, since the present invention relates to a washing machine using steam, a schematic configuration of the present invention will be described, focusing a steam generator.

A washing machine according to the present invention includes a steam generator 100, a water supply path 200, a steam path 500 and a control assembly 400.

The steam generator 100 supplies steam into a drum 30. Thus, it is preferable that an outlet of the steam generator 100 is in communication with the drum 30.

The steam generator 100 has a heater 110 for heating water, and the heater 110 may be a coil heater, a sheath heater or an induction heater.

The water supply path 200 is connected with the steam generator 100 and a tub (a drum). The water supply path 200 is connected with a water source such as a faucet. Water supply valves 310 and 320 are provided each on the water supply path 200 for selectively opening/closing the water supply path 200. At least one of the water supply valves 310 and 320 controls to supply wash water into the steam generator 100.

Meanwhile, the steam path 500 is connected with the steam generator 100 and supplies steam generated in the steam generator 100 into the drum 30. That is, a first end of the steam generator 100 is connected with the steam generator 100, and a second end thereof is connectedly in communication with the drum 30.

The control assembly 400 controls operations of each component in the washing machine, and includes an option select part 410, a course select part 420, a steam select part 430 and a controller 440.

Referring to FIG. 4, the control assembly 400 will be described.

The course select part 420 is for a user to select a course among several courses. The course select part 420 could include a dial structure, such as a rotation knob 421 for supplying a selected signal after sensing whether a course is selected through rotation. That is, preferably a course is selected based on the rotation angle and the rotation direction of the rotation knob 421. The course select part 420 may be a touch panel.

The Courses provided by the course select part 420 could include a kind of fabric course such as wool, synthetic and beddings, a standard course, a freshen-up (refresh) course, a tub/drum wash course and a sanitary course. The freshen-up (refresh) course is for mainly removing wrinkles from the laundry by using steam. A method for performing the freshen up course may be achieved in several ways and the detailed explanation is omitted. The tub/drum clean course is for sterilizing and washing the tub/drum by supplying steam without water within the drum. The courses are not limited as shown in FIG. 4, and alternatively may be varied according to a washing machine. For example, another wash course according to a condition of spoiled laundry may be further included.

Preferably, when steam is supplied into the drum, the drum is tumbled. The tumbling means that the drum is rotated at a lower speed such that the laundry is not attached to an inner wall of the drum by centrifugal force. That is, the rotation speed for the tumbling is more than 1 G (acceleration of gravity). The drum could be rotated in a clockwise/counter-clockwise direction. On the other hand, it is preferable to alternatively rotate the drum at a high speed of more than 1 G and tumble the drum during the general washing courses.

The option select part 410 is for operating details of each wash course, and includes a plurality of buttons supplying selected signals to the controller 440 after sensing whether a user pushes buttons. For example, each button of the option select part 410 may include at least one of buttons such as a wash button 411 for selecting a wash course, a rinse button 41 for selecting numbers of rinsing, a speed button 413 for selecting rotation speed of the drum, a water temperature button 414, dry button 415. Preferably, a steam adjust button 416 is provided for adjusting the various options (factors) of steam generation. The steam adjust button 416 may be considered as a kind of an option select part.

Although not seen in the option select part 410, a lamp turns on/off in case that a course, in which steam could be used, is selected by operation of the course select part 420. Alternatively, instead of buttons, and the term of <button> is used just for convenience sake in this specification.

Meanwhile, the steam select part 430 is for selecting the operation of the steam generator 100. The steam select part 430 may transmit the selected signal to the controller 440 after sensing whether the user pushes the option select part, or it may transmit the selected signal to the controller 440 after sensing where a user dials the course select part 420. Alternatively, the steam select part 430 may transmit the selected signal to the controller 440 after sensing whether a user pushes the option select part and sensing where a user dials the course select part 420.

The steam select part 430 may have kinds of buttons so that a user may select to operate the steam generator 100. The corresponding selected signals are generated from the course select part 420 when each wash course is selected. The selected signals are sensed by a sense part (not shown) and transmitted to the controller 440. Here, the sense part may be an A/D converter or an input/output interface so as to sense exactly which wash course is selected. Furthermore, the sense part may be connected with the steam select part 430 or the controller 440. The controlling system for sensing and transmitting the selected signals may be achieved in many ways and could be known to the skilled in the art, thereby the specific description thereof being omitted.

According to the present invention, the controller 440 controls the steam generator based on both a wash course inputted (selected) from the course select part 420 by the user (hereinafter, an inputted wash course) and a steam usage command inputted (selected) from the steam select part 430 by a user (hereinafter, a steam select signal). That is why the operation of steam generator 100 is not necessary in all kinds of wash courses. For example, it is not needed to use steam in wool and sheet/pillow washing courses, because the wool and sheets/pillows are sensitive to heat. Further, if steam is contacted to those kinds of fabrics, the fabrics may be damaged. Accordingly, preferably to prevent a user from being confused, the steam generator is not operated when performing a course where the operation of the steam generator is not necessary although the user selects the steam select part 430.

Thus, according to the present invention, the controller 440 controls the steam generator 100 to generate steam, only in case that the inputted wash course is a predetermined wash course as a wash course using steam (hereinafter, a steam wash course).

The feature of this embodiment described above may be embodied in various ways. For example, the steam select signal is transmitted to the controller 440, only in case that the inputted wash course is the steam wash course. Alternatively, even a steam select signal is transmitted to the controller 440 regardless of whether the inputted wash course is a steam wash course, and the steam select signal may be ignored in case that the inputted wash course is not the steam wash course.

Next, for the sake of precise description, it will be embodied below that the input signal selected at the steam select part 430 is transmitted to the controller 440 only in case that an inputted wash course is a steam wash course.

According to the present invention, the steam select part 430 is in accordance with the each wash course selected in the course select part 420, which means that the controller 440 is selectively connected to the steam select part 430.

Here, the expression <selectively be operated> may mean that the mechanical operation of steam select part 430 is selectively performed and also may mean that the signal transmission between the steam select part 430 and the controller 440 is selectively performed regardless of the mechanical operation of the steam select part 430. in latter case, signal transmission between the controller 440 and the steam select part 430 is activated, in case that an inputted wash course can perform steam washing. Whereas, signal transmission between the controller 440 and the steam select part 430 is shut off, in case that an inputted wash course cannot perform steam washing.

The controller 440 is programmed to operate only when the two conditions are satisfied. The two conditions are the one where an inputted wash course is a steam wash course capable of using a steam course selected by dialing the course select part, and the other where the steam select part is selected.

As mentioned above, the steam select part 430 is selectively operated based on the selection of the wash select part 420, and alternatively the steam select part 430 may be selectively operated based on the selection of the option select part 410.

Another embodiment according to the present invention will be described as follows.

The control assembly 400 includes a steam wash select displayer 450 to alert a user that it is possible to select whether he/she may select the steam select part 340. Preferably, the steam wash select displayer 450 uses a lamp selectively turning on/off.

The operation of steam wash select displayer 450 is activated with the control of the controller 440 in case that an inputted wash course is a steam wash course. At that time, a steam wash course may be at least one of the courses such as a standard, a freshen-up and a drum/tub wash course.

The controller 440 of the control assembly 400 controls the operations of heater 110 as well as of each water supply valve 310 and 320 based on signals received from the steam select part 430. Alternatively, as described above, the controller 440 can read an inputted wash course selected by the course select part 420, and also controls the steam wash select displayer 450 to be activated in case that the read wash course is a predetermined steam wash course. Although the steam select part 430 is selected, the steam generator 100 is controlled not to be operated in case that an inputted wash course is a course where it is impossible to control the steam generator 100 as predetermined.

Preferably, a steam adjust part is further provided to select at least one of a steam starting time, an amount of steam, degree of steam injection and steam generation time. Of course, when several factors of steam generation are adjusted, washing performance using steam may be differentiated, but a power-saving function may be satisfied.

The steam adjust part may use the steam select part 430. Preferably, an auxiliary steam adjust unit is provided and may be a steam adjust button 416. The steam adjust button 416 may be a kind of an option select part 410.

It is possible in the steam adjust part to adjust various kinds of factors, preferably, an amount of steam. For example, at least one of an economical steam, a speed steam, a turbo steam and a small steam is selected in the steam adjust part. Also, once a steam operation which needs a relatively large amount of steam, for example, an economical steam and a turbo steam is selected, it is preferred to drive the steam generator until the drum temperature reaches a preset temperature. Also, once a steam operation which needs a relatively small amount of steam is selected, it is preferred to operate the steam generator for a preset time period. It is possible to use a heater for heating wash water as a heater for heating the drum. Alternatively, other heaters may be used.

Another embodiment of the present invention will be described as follows.

Preferably, an indicator 422 is further provided in the course select part 420 to alert a user which wash course is a steam wash course. Thus, a user may not be confused, because he/she can recognize a steam wash course in advance.

The indicator 422 may use a LCD, a LED and a lamp. It is simple to notify the user by using the term <STEAM> provided on the control assembly, as shown in FIG. 4. Preferably, the letters <STEAM> is printed on the surface of the control assembly.

A steam wash displayer 460 is provided in the control assembly 400 for notifying the user that steam washing is performed. Here, the steam wash displayer 460 may be a LCD and a LED, but preferably a lamp turning on/off during the steam washing.

Referring to FIGS. 3 to 5, a process for controlling the embodiment of the washing machine according to the present invention will be described.

First, the washing machine is operated by the buttons and rotation knob operated by the user, and these kinds of operations could be checked by the controller 440 (S110).

Once a wash course is selected in a course select part 420 operated by the user, the controller 440 checks which wash course is selected (S120).

It is determined whether the selected (inputted) wash course can control a steam generator 100, that is, one of steam wash courses is selected. (S130). That is performed by comparing the inputted wash course with steam wash courses determined and stored in the controller 440.

If the inputted wash course is a steam wash course, the controller 440 turns on a steam wash select displayer 450, for example, a lamp to alert a user that the steam select part is selectable. Thus, a user can select whether he/she uses steam (S140). Together with that, signal transmission is activated between the controller 440 and the steam select part 430. Alternatively, as described before, it may be always possible to transmit signals between the controller 440 and the steam select part 430, and the selection of steam select part 430 may be ignored by the controller 440 in case that the inputted wash course is not a steam wash course.

On the other hand, in case that the inputted wash course is not a steam wash course, a lamp 450 does not turn on and a user is not requested to select the steam select part 430 (S180). Nevertheless, a user may select the steam select part 430. However, according to the present invention, a signal that the steam select part is selected by the user is substantially not considered when the inputted wash course is not a steam wash course. Here, preferably, a user is alerted that selecting the steam select part 430 is not appropriate. For example, an error message is displayed or a beep, sounds (or a voice message).

The controller 440 checks whether a user selects the steam select part 430 (S150). In case that the user has selected the steam select part 430, steam is supplied to a drum to perform a selected wash course with steam according to the predetermined algorithm (S160).

For example, if a user selects both a standard course and the steam select part, the controller 440 controls the washing machine based on the algorithm for the standard course and the steam generation. The controller 440 controls a drum (not shown), water supply valves 310 and 320 and a heater 110 of a steam generator 100 for performing the corresponding course. At that time, it is preferable that the water supply valve 320 is a solenoid valve, and the switch is a contact switch selectively contacted with a power end by the controller 440. More specifically, once a steam wash signal is inputted through the steam select part 430, the water supply valve 320 is controlled to supply a predetermined amount of water into the steam generator 100 by the controller 440 through a water supply path 200. Also, the switch is controlled to supply power to the heater 110 of the steam generator 100 by the controller 440. Here, a water level sensor is provided within the steam generator 100 for measuring a level of water supplied thereto. Thus, once the supplied water level reaches a predetermined water level, power is supplied to the heater 110. Alternatively, once the water supply valve 320 is opened to supply water into the steam generator 100 for the predetermined time period, power may be controlled to be automatically supplied to the heater 110 by the controller 440.

Meanwhile, when the steam wash course runs, a steam wash displayer 460 provided in the control assembly 400 is turned on to alert a user that steam washing is running.

In case that the user has not selected the steam select part 430, the wash course runs based on predetermined basic algorithms, that is, as the steam generator 100 is not controlled. At that time, the steam wash displayer 460 of the control assembly 400 is not turned on to alert the user that steam washing is not running.

Once the wash course is completed, the controller 440 gets ready to check whether a user selects a new wash course after completing the control.

Meanwhile, the control assembly 400 of the washing machine according to the present invention may not be limited to its structure and operation process of the embodiment described above. That is, the steam select part 430 may be one or more buttons which can be controlled by various manual operations such as selecting a steam supply start/stop time, a steam supply amount, a steam supply time. Of course, it is preferred that the various factors can be selected in case that the wash course selected by the user is one of the predetermined steam wash courses.

The method for controlling the washing machine according to the present invention may not be performed only through the process described above.

For example, one of wash courses is selected by a user and it is judged whether the selected wash course is a wash course using steam. Hence, in case that the selected wash course can use steam, the steam select part is activated to induce the selection. After that, in case that the steam select part is selected by a user, steam washing may be performed. That is, it is directly judged whether the selected wash course can use steam without comparing the selected wash course with a preset course to perform steam washing. Of course, preferably a standard course is performed although a user selects the steam select part, once it is judged that the selected wash course is not a course using steam.

Although the embodiments are described by embodying a washing machine, the present invention is not limited thereto. For example, the present invention may be applied to a dyer having a steam generator.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention provides a method for controlling a washing machine having a steam generator and the method for the washing machine, in which a wash course using steam is operated only in case of a selected wash course is one of the steam courses using steam. Therefore, the present invention has an industrial applicability that various disadvantages resulting from malfunctions of the steam generator may be prevented.

The invention claimed is:

1. A laundry machine comprising:

a control assembly;

a course selector allowing a user to select a course from a plurality of courses;

a steam selector disposed on the control assembly separate from the course selector and allowing a user to select to use steam together with a selected course, wherein the steam selector allows the user to select to use steam when the selected course is a course that does permit the use of steam and the steam selector does not allow the user to select to use steam when the selected course is a course that does not permit the use of steam; and a controller to control a steam generator for the selected course when steam is selected to be used through the steam selector.

2. The laundry machine of claim 1, wherein the selection of using steam via the steam selector is allowed where the selected course is a predetermined course among the plurality of courses.

3. The laundry machine of claim 2, wherein the selection of using steam via the steam selector is allowed when the selected course is the predetermined course.

4. The laundry machine of claim 3, wherein the controller is enabled to receive a signal from the steam selector when the selected course is the predetermined course.

5. The laundry machine of claim 3, wherein the steam selector is enabled to send a signal to the controller when the selected course is the predetermined course.

6. The laundry machine of claim 2, further comprising a first indicator to indicate that the selection of using steam is allowed for the predetermined course.

7. The laundry machine of claim 6, wherein the first indicator indicates that the selection of using steam is allowed after the predetermined course has been selected.

8. The laundry machine of claim 6, wherein the first indicator includes a lamp or a light emitting device (LED).

9. The laundry machine of claim 6, wherein the first indicator is part of the steam selector.

10. The laundry machine of claim 6, wherein the first indicator surrounds the steam selector.

11. The laundry machine of claim 2, further comprising a display to indicate that the steam is being used during operation of the predetermined course.

12. The laundry machine of claim 11, wherein the display is located at the control assembly.

13. The laundry machine of claim 2, wherein the predetermined course includes at least one of a standard course, a tub/drum wash course, and a freshen-up course.

14. The laundry machine of claim 2, further comprising a second indicator to indicate which course among the plurality of courses allows steam to be used.

15. The laundry machine of claim 14, wherein the second indicator includes at least one of an LCD, a light emitting diode (LED), a lamp, and a print.

16. The laundry machine of claim 1, wherein the course selector includes a rotation knob.

17. The laundry machine of claim 1, wherein the steam selector includes a button.

18. The laundry machine of claim 1, wherein the controller does not respond to a signal from the steam selector when the selected course is a course that does not permit the use of steam.

19. The laundry machine of claim 1, wherein the controller causes an alarm to sound when the steam selector is used to select steam when the selected course is a course that does not permit the use of steam.

20. A laundry machine comprising:

a control assembly;

a course selector allowing a user to select a course from a plurality of courses;

a steam selector disposed on the control assembly separate from the course selector and allowing a user to select to use steam together with a selected course, wherein the steam selector can be enabled when the selected course is a predetermined course among the plurality of courses that permit the use of steam and the steam selector cannot be enabled when the selected course is a course that does not permit the use of steam; and a controller to control introduction of steam for the selected course when steam is selected to be used via the steam selector.

21. The laundry machine of claim 20, wherein the controller is enabled to receive a signal from the steam selector when the selected course is the predetermined course.

22. The laundry machine of claim 20, wherein the steam selector is enabled to send a signal to the controller when the selected course is the predetermined course.

23. The laundry machine of claim 20, further comprising a display to indicate whether the steam is being used during operation of the selected course.

24. The laundry machine of claim 20, further comprising a first indicator disposed on the control assembly to alert the user when steam may be used with the selected course.

25. The laundry machine of claim 24, wherein the first indicator includes a lamp or a light emitting device (LED).

26. The laundry machine of claim 24, wherein the first indicator is part of the steam selector.

27. The laundry machine of claim 24, wherein the first indicator surrounds the steam selector.

28. The laundry machine of claim 20, wherein the predetermined course includes at least one of a standard course, a tub/drum wash course, and a freshen-up course.

29. The laundry machine of claim 20, further comprising a second indicator to indicate which course among a plurality of courses allows steam to be used.

30. The laundry machine of claim 29, wherein the second indicator includes at least one of an LCD, a light emitting diode (LED), a lamp, and a print.

31. The laundry machine of claim 20, wherein the course selector is a rotation knob.

32. The laundry machine of claim 20, wherein the steam selector is a button.

33. The laundry machine of claim 20, wherein the controller causes an alarm to sound when the steam selector is used to select steam when the selected course is a course that does not permit the use of steam.

34. A laundry machine comprising:

a cabinet having a tub or drum to wash laundry therein, and a steam generator to supply steam to the laundry disposed in the tub or drum;

a control assembly disposed on an outer surface of the cabinet providing a control interface for a user;

a course selector disposed on the control assembly to allow the user to select a course from a plurality of courses, the course selector comprising a dial;

a steam selector disposed on the control assembly separate from the course selector and allowing the user to select to use steam with the selected course;

a first indicator disposed on the control assembly to alert the user when steam can be used with the selected course; and a controller to receive a signal sent by the steam selector and to control introduction of steam to the laundry during the selected course based on the signal, wherein the steam selector includes a push button and sends the signal based on an input received by the push button.

35. The laundry machine of claim 34, wherein the controller is enabled to receive a signal from the steam selector when the selected course is a predetermined course of the plurality of courses.

36. The laundry machine of claim 35, wherein the predetermined course includes at least one of a standard course, a tub/drum wash course, and a freshen-up course.

37. The laundry machine of claim 34, wherein the steam selector is enabled to send a signal to the controller when the selected course is the predetermined course.

38. The laundry machine of claim 34, wherein the steam selector is prevented from sending a signal to the controller when the selected course is a course that does not permit the use of steam.

39. The laundry machine of claim 34, further comprising a display to indicate whether the steam is being used during operation of the selected course.

40. The laundry machine of claim 34, wherein the first indicator includes a lamp or a light emitting device (LED).

41. The laundry machine of claim 40, wherein the first indicator is part of the steam selector.

42. The laundry machine of claim 40, wherein the first indicator surrounds the steam selector.

43. The laundry machine of claim 34, further comprising a second indicator to indicate which course among a plurality of courses allows steam to be used.

44. The laundry machine of claim 43, wherein the second indicator includes at least one of an LCD, a light emitting diode (LED), a lamp, and a print.

45. The laundry machine of claim 34, wherein the controller causes an alarm to sound when the steam selector is used to select steam when the selected course is a course that does not permit the use of steam.

46. A laundry machine comprising:

a control assembly;

a course selector allowing a user to select a course from a plurality of courses;

a steam selector disposed on the control assembly separate from the course selector and allowing a user to select to use steam together with the selected course; and a controller to control whether or not steam is introduced for the selected course based on the signal sent from the steam selector, wherein the plurality of courses include courses that can receive steam and courses that cannot receive steam, and wherein the selected course is a course that can receive steam and activating the steam selector sends a signal to add steam during the selected course, and not activating the steam selector prevents steam during the selected course even where the selected course is a course that can receive steam.

47. The laundry machine of claim 46, wherein the controller is enabled to receive a signal from the steam selector when the selected course is a predetermined course of the plurality of courses.

48. The laundry machine of claim 47, wherein the predetermined course includes at least one of a standard course, a tub/drum wash course, and a freshen-up course.

49. The laundry machine of claim 46, wherein the steam selector is enabled to send a signal to the controller when the selected course is the predetermined course.

50. The laundry machine of claim 46, wherein the steam selector is prevented from sending a signal to the controller when the selected course is a course that does not permit the use of steam.

51. The laundry machine of claim 46, further comprising a display to indicate whether the steam is being used during operation of the selected course.

52. The laundry machine of claim 46, further comprising a first indicator disposed on the control assembly to alert the user when steam may be used with the selected course.

53. The laundry machine of claim 52, wherein the first indicator includes a lamp or a light emitting device (LED).

54. The laundry machine of claim 52, wherein the first indicator is part of the steam selector.

55. The laundry machine of claim 52, wherein the first indicator surrounds the steam selector.

56. The laundry machine of claim 46, further comprising a second indicator to indicate which course among a plurality of courses allows steam to be used.

57. The laundry machine of claim 56, wherein the second indicator includes at least one of an LCD, a light emitting diode (LED), a lamp, and a print.

58. The laundry machine of claim 46, wherein the controller causes an alarm to sound when the steam selector is used to select steam when the selected course is a course that does not permit the use of steam.

59. A laundry machine comprising:

a control assembly;

a course selector allowing a user to select a course from a plurality of courses;

a steam selector disposed on the control assembly separate from the course selector and allowing the user to select to use steam together with a selected course;

a steam adjuster, disposed on the control assembly separate from the course selector and the steam selector, the steam adjuster sending a signal to adjust at least one factor associated with steam, the signal corresponding to the at least one factor associated with the steam as desired by the user; and a controller to control the introduction of steam based on a signal sent from the steam selector, and when steam is selected at the steam selector the controller to control adjustment of the at least one factor associated with the steam based on the signal sent from the steam adjuster and the steam adjuster is not operable during at least one wash course selectable via the course selector.

60. The laundry machine according to claim 59, wherein the controller controls adjustment of at least one of a steam starting time, an amount of steam, a degree of steam injection, and a steam generation time.

61. The laundry machine according to claim 59, wherein the steam adjustor allows a user to select at least one of an economical steam, a speedy steam, a turbo steam, and a small amount of steam.

62. The laundry machine according to claim 59, further comprising a steam generator to generate steam, wherein the controller controls the steam generator until a tub or drum reaches a predetermined temperature based on an input by the user.

63. The laundry machine according to claim 59, further comprising a steam generator to generate steam, wherein the controller controls the steam generator to generate steam for a predetermined amount of time based on an input by the user.

64. The laundry machine according to claim 59, wherein the steam adjuster is operable during one of a standard course, a tub/drum wash course, a sanitary course, and a freshen-up course.

65. The laundry machine according to claim 59, further comprising an first indicator to indicate to the user the at least one factor associated with steam that is adjusted via the steam adjustor.

66. The laundry machine according to claim 59, further comprising an third indicator disposed on the control assembly to alert the user when steam may be used with the selected course.

67. The laundry machine according to claim 66, wherein the third indicator is part of the steam selector.

68. The laundry machine of claim 66, wherein the third indicator surrounds the steam selector.

69. The laundry machine of claim 59, wherein the controller causes an alarm to sound when the steam selector is used to select steam when the selected course is a course that does not permit the use of steam.

70. A laundry machine comprising:

a cabinet having a tub or drum to wash laundry therein, and a steam generator to supply steam to the laundry disposed in the tub or drum;

a control assembly disposed on an outer surface of the cabinet providing a control interface for a user;

a course selector disposed on the control assembly to allow the user to select a course from a plurality of courses, the course selector comprising a dial;

a steam selector disposed on the control assembly separate from the course selector and allowing the user to select to use steam with the selected course; and a controller to receive a signal sent by the steam selector and to control introduction of steam to the laundry during the selected course based on the signal, wherein the steam selector includes a push button and sends the signal based on an input received by the push button.

71. The laundry machine of claim 70, wherein the controller does not respond to a signal of from the steam selector when the selected course is a course that does not permit the use of steam.

72. The laundry machine of 70, further comprising a display to indicate whether the steam is being used during operation of the selected course.

73. The laundry machine of claim 70, further comprising a first indicator disposed on the control assembly to alert the user when steam can be used with the selected course.

74. The laundry machine of claim 73, wherein the first indicator includes a lamp or a light emitting device (LED).

75. The laundry machine of claim 73, wherein the first indicator is part of the steam selector.

76. The laundry machine of claim 73, wherein the first indicator surrounds the steam selector.

77. The laundry machine of claim 70, wherein the selected course is at least one of a standard course, a tub/drum wash course, and a freshen-up course.

78. The laundry machine of claim 70, further comprising a second indicator to indicate which course among a plurality of courses allows steam to be used.

79. The laundry machine of claim 78, wherein the second indicator includes at least one of an LCD, a light emitting diode (LED), a lamp, and a print.

80. The laundry machine of claim 70, wherein the controller causes an alarm to sound when the steam selector is used to select steam when the selected course is a course that does not permit the use of steam.

* * * * *